United States Patent [19]

Stewmon

[11] 4,149,552

[45] Apr. 17, 1979

[54] FOUNTAIN BRUSH

[76] Inventor: Billy J. Stewmon, Rte. #1, Box 51, Forrest City, Ark. 72335

[21] Appl. No.: 902,895

[22] Filed: May 4, 1978

[51] Int. Cl.[2] ..... A45D 44/18

[52] U.S. Cl. ..... 132/84 B

[58] Field of Search ..... 132/84, 85, 88.5, 88.7; 401/64, 75-77, 150, 154, 86, 268, 270, 282, 155, 164, 169, 173, 172; 206/56

[56] References Cited

U.S. PATENT DOCUMENTS

| | | | |
|---|---|---|---|
| 770,971 | 9/1904 | Kunkel | 215/329 |
| 1,340,043 | 5/1920 | Grace | 132/84 B |
| 2,309,000 | 1/1943 | Morrison | 401/75 X |
| 2,318,152 | 5/1943 | Gelardin | 206/56 |

FOREIGN PATENT DOCUMENTS

| | | | |
|---|---|---|---|
| 199616 | 11/1938 | Switzerland | 401/173 |

*Primary Examiner*—G. E. McNeill

*Attorney, Agent, or Firm*—Littlepage, Quaintance, Murphy, Richardson and Webner

[57] ABSTRACT

A fountain brush includes a three piece reservoir removably secured to the stem of a brush element. A cylindrical chamber of the reservoir includes a pair of helical grooves running along an inside wall. A hollow bifurcated cylindrical liner slips within the cylindrical chamber and is retained by partially circumferential protusions engaging a circular retaining ring on the inner wall of the reservoir. A follower is slidably situated within the bifurcated liner, the follower having two diametrically opposed projections extending through the longitudinal slots bifurcating the liner and engaging the helical grooves of the inner wall of the reservoir. The follower includes a circumferential lip maintaining intimate contact with the inner surface of the liner.

7 Claims, 11 Drawing Figures

FIG. 1
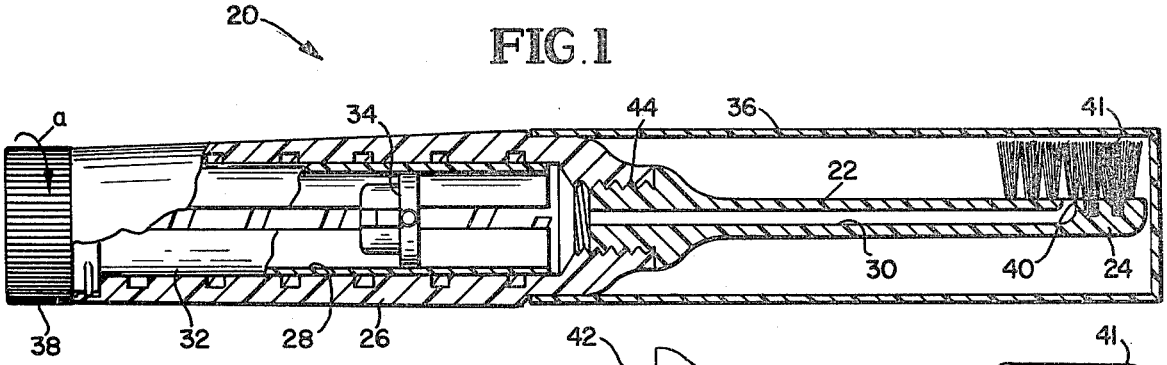
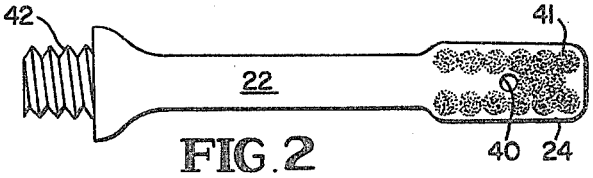
FIG. 2
FIG. 3
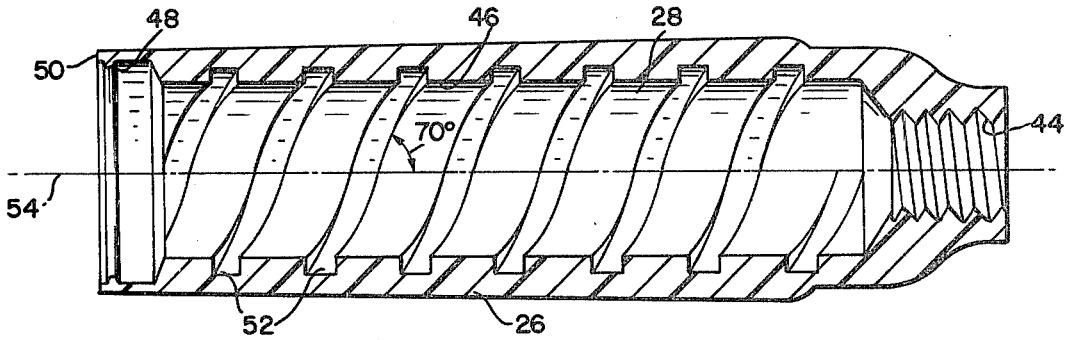
FIG. 4
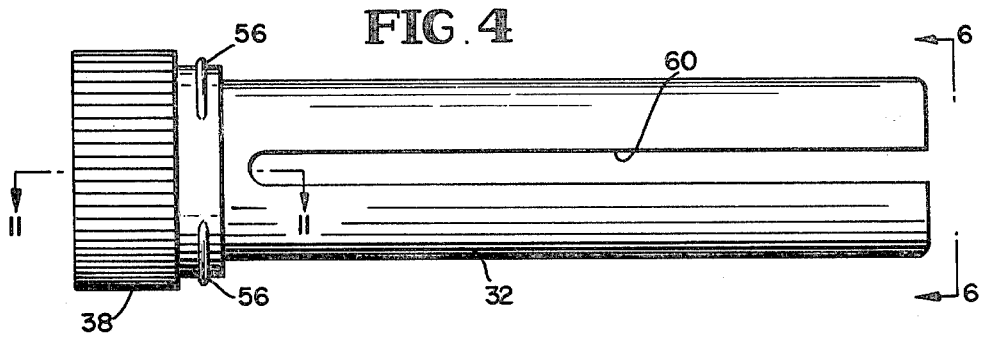
FIG. 5
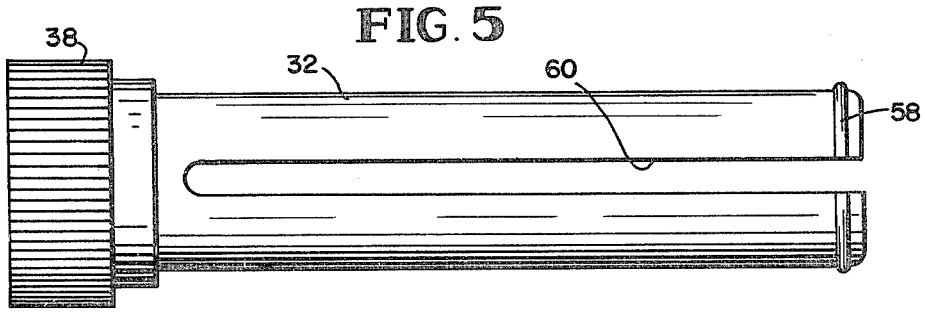

FOUNTAIN BRUSH

BACKGROUND OF THE INVENTION

1. Field of the Invention

The present invention relates to fountain brushes such as toothbrushes and the like in which the handle includes a reservoir for retaining and periodically dispensing into the bristles of the brush a viscous or plastic medium. Devices of this type are to be found in the United States Class 401, Subclass 268+.

2. Description of the Prior Art

Numerous devices exist in the prior art directed to fountain brushes having reservoirs in the handle of the brush for the dispensing of viscous paste or plastic substance onto the bristles of the brush through a bore existing in the stem of the brush between the handle and head. While it is known to employ a plunger or follower to advance the plastic or paste substance within the reservoir, the overall dimensions of prior art reservoirs have generally decreased in size as the follower was advanced. Thus, the fountain brush achieved its minimum size only when the reservoir experienced a substantial decrease in capacity or content.

It is therefore an object of the present invention to provide a fountain brush whose overall dimensions do not change with utilization of the material within the reservoir. The advantage of this feature is that the accidental dropping of the brush onto the actuator for the follower will not cause an unwanted discharge of the plastic medium contained within the handle of the brush.

SUMMARY OF THE INVENTION

A fountain brush according to the present invention includes a stem having a longitudinal bore extending therethrough, the stem having a fastening means on one end thereof. A brush head is provided integral with the stem on the end opposite of the fastening means. The head includes a bristle region having bristles fixed in the head. The longitudinal bore opens within this bristled region of the head.

A reservoir cooperatively engages the fastening means of the stem such that an inner wall of the reservoir forms a cylindrical chamber which communicates with the longitudinal bore of the stem. The inner wall of the reservoir has at least two helical grooves extending along substantially the entire length of the inner wall. A hollow cylindrical liner lines the cylindrical chamber and is rotatable with respect to the reservoir wall. The liner includes a closed end which extends longitudinally outside the cylindrical chamber, the closed end being adapted for manual manipulation. The liner includes an at least partially circumferential protusion which engages a circular retaining ring on the inside surface of the inner wall of the reservoir. The liner is longitudinally divided by at least two longitudinal slots extending over a major portion of the length of the liner starting at an end adjacent to the fastening means on the stem of the brush.

A follower is slidably situated within the liner. The follower includes at least two projections extending through the longitudinal slots of the liner, the projections engaging the helical grooves of the inner wall of the reservoir. The follower includes a circumferential lip maintaining intimate contact with the inner surface of the liner so as to permit the dispensing of the plastic material contained within the reservoir.

In a preferred embodiment the projections on the follower which engage the helical grooves on the inner wall of the reservoir terminate as generally truncated cones extending radially outward from the circumferential lip. The circumferential lip of the follower preferably comprises an outer ring intimately engaging the inner surface of the liner and a thin diagonal web uniting the outer ring to the central portion of the follower, a trough being formed between the central portion and the outer ring.

In a preferred embodiment, the hollow cylindrical liner is bifurcated by a pair of diametrically opposite parallel linear slots extending over a major portion of the length of the cylindrical liner. The portion of the cylindrical liner extending longitudinally outside the cylindrical chamber is typically knurled so as to facilitate manual operation of the fountain brush. In the preferred embodiment the partially circumferential protusions on the hollow cylindrical liner comprise three equally-spaced segments, each segment being about 60° in extent. These three equally-spaced segments engage an integral inwardly extending ring on the inner wall of the reservoir adjacent the end of the reservoir opposite that engaging the fastening means of the brush stem.

The various features of a fountain brush constructed according to the present invention permit each of the brush elements to be injection molded thus affording unique advantage of simple low cost production. Other advantages of the various features of the present invention will become apparent to those skilled in the art from the following description, taken in conjunction with the accompanying drawings.

BRIEF DESCRIPTION OF THE DRAWINGS

FIG. 1 is a plan view partly in section of a fountain brush according to the present invention.

FIG. 2 is an elevation view of the stem and head portion of the fountain brush illustrated in FIG. 1.

FIG. 3 is a sectional view of a reservoir of a fountain brush of the present invention.

FIG. 4 is a plan view of a hollow cylindrical liner designed to fit within the reservoir of FIG. 3.

FIG. 5 illustrates an alternative embodiment of the cylindrical liner illustrated in FIG. 4.

DESCRIPTION OF THE PREFERRED EMBODIMENTS

Figure 6:
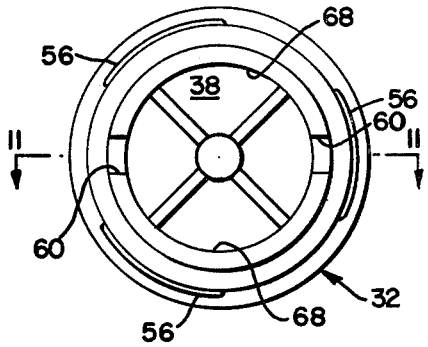
FIG. 6 illustrates an end view of the hollow cylindrical liner illustrated in FIG. 4 as seen from the right side of FIG. 4.
Figure 7:
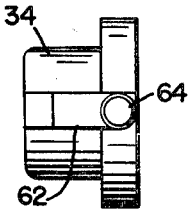
FIG. 7 is an elevation view of a follower employed in a fountain brush of the present invention.
Figure 8:
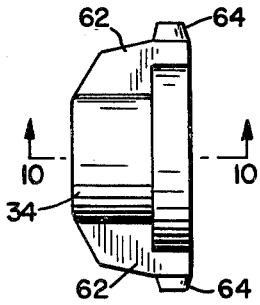
FIG. 8 is a plan view of the follower illustrated in FIG. 7.
Figure 9:
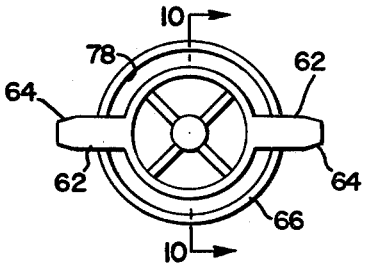
FIG. 9 is an end view of the follower illustrated in FIGS. 7 and 8.
Figure 10:
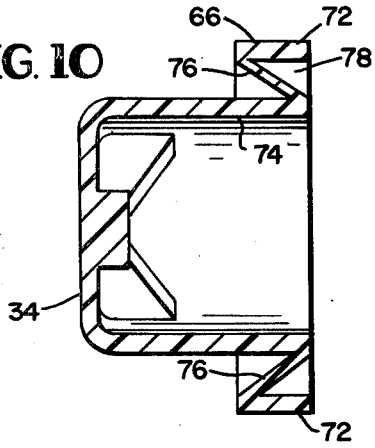
FIG. 10 is a sectional view taken along lines 10—10 as shown in FIGS. 8 and 9.

A fountain brush according to the present invention is illustrated in its entirety in FIG. 1 as (20). The fountain brush (20) consists generally of a stem (22) and a head (24) integral with the stem. A reservoir (26) engages the stem (22) such that a cylindrical chamber (28)

communicates with the longitudinal bore (30) extending through stem (22) to head (24). A hollow cylindrical liner (32) is rotatable within the cylindrical chamber (28) to propel a follower (34) throughout the length of the cylindrical chamber (28). A cap (36) can be conveniently used to cover the brush head (24) and stem (22) during periods of non-use.

During use, the follower (34) is advanced by rotating a closed end (38) of the cylindrical liner in the direction of arrow (a) thereby causing any plastic substance contained within the reservoir to be extruded through bore (30) and out of orifice (40) in the bristled region of head (24) as illustrated in FIGS. 1 and 2. The bristles (41) surrounding the orifice (40) receive the substance thus deployed and aid in the working of this substance onto the desired work surface, not illustrated. Preferably, the stem (22) includes a screw fastening means (42) which can most conveniently match the threads of commercial dispensing containers of substances sought to be used with the fountain brush. For example, when a fountain brush of the instant invention is used as a fountain toothbrush, the threads (42) of stem (22) might most desirably match the threads on conventional commercial toothpaste tubes. In this way, the matching threaded portion of the reservoir (44) could be cooperatively threaded directly on the tube of toothpaste and the paste thus injected into the reservoir concurrently with the retrocession of the follower (34).

The reservoir (26) illustrated in sectional detail in FIG. 3 cooperatively engages the fastening means (42) of stem (22) with threads (44) provided on one end of the reservoir. An inner wall (46) of the reservoir defines the cylindrical chamber (28) which communicates with the longitudinal bore (30) of stem (22). The inner wall (46) of the reservoir includes a circular retaining ring (48) which is illustrated in FIG. 3 to comprise an integral inwardly extending ring adjacent end (50) of the reservoir opposite the end having threads (44) which engage the stem (22). A pair of helical grooves (52) extend along substantially the entire length of the inner wall (46). The helical grooves are illustrated to have a pitch angle of about 70° with respect to the axis (54) of the cylindrical chamber.

The hollow cylindrical liner (32) illustrated in a first embodiment in FIGS. 4 and 6 lines the cylindrical chamber (28) and is rotatable with respect to the reservoir (26). An at least partially circumferential protusion (56) on the hollow cylindrical liner (32) engages the circular retaining ring (48) on the inner wall of the reservoir (26). The partially circumferential protusion (56) is illustrated in FIG. 6 to comprise three equally-spaced segments, each segment being about 60° in extent. An alternative embodiment is illustrated in FIG. 5 wherein a circumferential protusion (58) is provided which could cooperatively engage with a retaining ring provided at the opposite end of the reservoir from the retaining ring (48) shown in FIG. 3. The cylindrical liner (32) is at least bifurcated by two elongate or longitudinal slots (60) extending over a major portion of the length of the liner (32). While in each of FIGS. 4, 5 and 6 there are illustrated only two longitudinal slots, it will be appreciated by those of ordinary skill in the art that this number might be increased to three, four, five or even six so long as other appropriate changes in design were made to accommodate this increase in number of longitudinal slots.

FIGS. 7 through 10 illustrate a follower (34) according to the present invention adapted to be situated within liner (32). The follower has at least two projections (62) which are adapted to extend through the longitudinal slots (60) of liner (32) and engage in the helical grooves (52) of the inner wall (46) of the reservoir (26). It is intended that the number of projections (62) would be equal to the number of longitudinal slots (60) existing in the liner (32). The projections (62) are illustrated to terminate generally as truncated cones (64) extending radially outwardly from a circumferential lip (66) designed to intimately contact the inner surface (68) of liner (32). This intimate contact of the circumferential lip (66) is provided by having an outer ring (72) united to the central portion (74) of the follower (34) by a thin diagonal web (76), a trough (78) being thereby formed between the central portion (74) and the outer ring (72).

Figure 11:
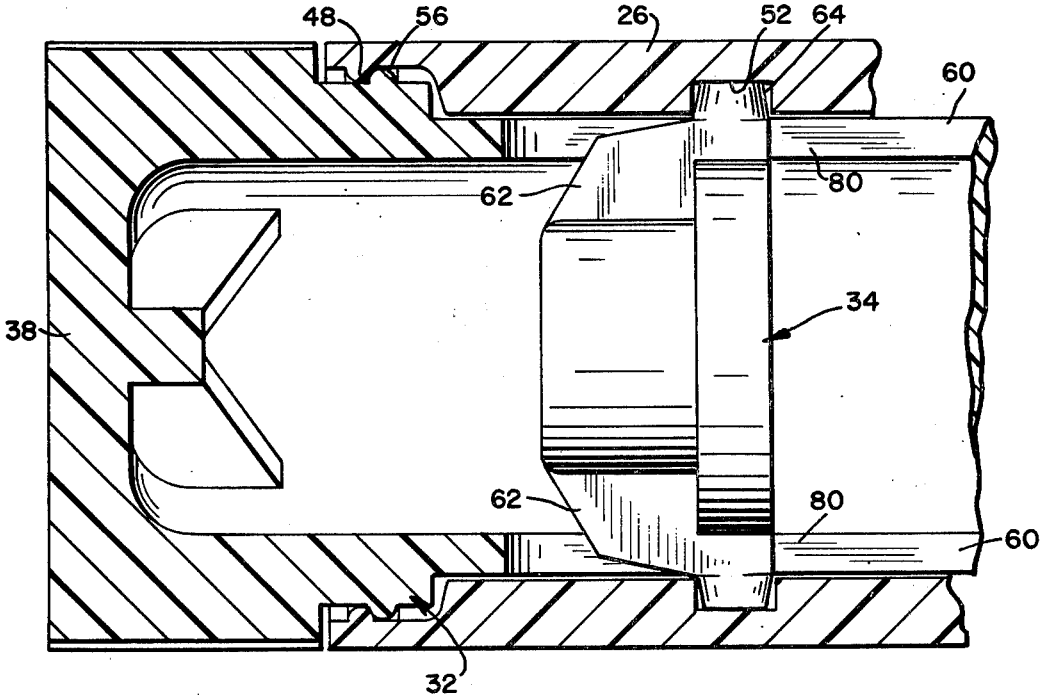
FIG. 11 is an enlarged sectional view of the hollow cylindrical liner illustrated in FIG. 4 taken along line 11—11 and also showing a portion of the reservoir wall and the coaction of the follower with the cylindrical liner and reservoir wall.

The enlarged sectional view illustrated in FIG. 11 shows in more detail the various structural and functional features of the cooperating reservoir, reservoir liner and follower. As closed end (38) of liner (32) is caused to rotate, an edge (80) of slots (60) bears on a side of projection (62) of the follower (34) thereby causing it to rotate with the rotating liner (32). This rotation of the follower (34) with respect to reservoir (26) causes the terminal end (64) of projection (62) to travel in the helical groove (52) which in turn causes the follower (34) to move longitudinally within the cylindrical liner (32). The cooperative engagement between the circular retaining ring (48) on the inner wall of the reservoir (26) and the partially circumferential protusion (56) on liner (32) is also illustrated in FIG. 11. It will be appreciated that unlike many embodiments of the prior art, the present invention is designed such that should the fountain brush be accidentally dropped, the impact on end (38) will not cause an unwanted dispensing of the plastic or paste substance stored within the reservoir.

Although the several features of this invention have been described in considerable detail with reference to the attached figures, it will be understood that variations and modifications can be effected within the spirit and scope of the invention as described above and as defined in the following claims.

What is claimed is:

1. A fountain brush comprising:

a stem having a longitudinal bore extending therethrough and having fastening means on one end thereof, a head integral with the stem on the end opposite the fastening means, the head having bristles fixed in a region thereof, the longitudinal bore opening within the bristled region of the head, a reservoir cooperatively engaging the fastening means of the stem, an inner wall of the reservoir forming a cylindrical chamber communicating with the longitudinal bore of the stem, the inner wall of the reservoir having a circular retaining ring and having at least two helical grooves extending along substantially the entire length of the inner wall, a hollow cylindrical liner lining the cylindrical chamber and rotatable with respect to the reservoir wall, the liner having a closed end extending longitudinally outside the cylindrical chamber and having an at least partially circumferential protrusion engaging the circular retaining ring on the inner wall of the reservoir, the liner being at least bifurcated by at least two longitudinal slots extending over a major portion of the length of the liner, and a follower slidably situated within the liner having at least two projections extending through the longitudinal slots of the liner and engaging the helical grooves of the inner wall of the reservoir, the follower having an outer ring intimately engaging the inner surface of the liner and a thin diagonal web uniting the outer ring to the central portion of the follower, a trough being thereby formed between the central portion and the outer ring.

2. The fountain brush of claim 1 wherein said circular retaining ring on the inner wall of the reservoir comprises an integral inwardly extending ring adjacent the end of the reservoir opposite that end engaging the fastening means of the stems.

3. The fountain brush of claim 1 wherein said helical grooves have a pitch angle of about 70° with respect to the axis of the cylindrical chamber.

4. The fountain brush of claim 1 wherein said closed end of the hollow cylindrical liner extending longitudinally outside the cylindrical chamber is knurled.

5. The fountain brush of claim 1 wherein said at least partially circumferential protrusion on the hollow cylindrical liner comprises three equally-spaced segments, each segment being about 60° in extent.

6. The fountain brush of claim 1 wherein said at least two projections on the follower are terminated generally as truncated cones extending radially outwardly from the outer ring.

7. A fountain brush comprising:

a stem having a longitudinal bore extending therethrough and having fastening means on one end thereof, a head integral with the stem on the end opposite the fastening means, the head having bristles fixed in a region thereof, the longitudinal bore opening within the bristled region of the head, a reservoir cooperatively engaging the fastening means of the stem, an inner wall of the reservoir forming a cylindrical chamber communicating with the longitudinal bore of the stem, the inner wall of the reservoir having a circular retaining ring and having at least two helical grooves extending along substantially the entire length of the inner wall, a hollow cylindrical liner lining the cylindrical chamber and rotatable with respect to the reservoir wall, the liner having a closed end extending longitudinally outside the cylindrical chamber and having an at least partially circumferential protrusion engaging the circular retaining ring on the inner wall of the reservoir, the liner being at least bifurcated by at least two longitudinal slots extending over a major portion of the length of the liner, and a follower slidably situated within the liner having at least two projections extending through the longitudinal slots of the liner and engaging the helical grooves of the inner wall of the reservoir, the follower having a circumferential lip maintaining intimate contact with the inner surface of the liner, the at least two projections on the follower being terminated generally as truncated cones extending radially outward from the circumferential lip.

* * * * *